US007565873B2

(12) United States Patent
Yamasaki

(10) Patent No.: US 7,565,873 B2
(45) Date of Patent: Jul. 28, 2009

(54) SEWING MACHINE

(75) Inventor: Hiroshi Yamasaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 12/073,259

(22) Filed: Mar. 3, 2008

(65) Prior Publication Data

US 2008/0216722 A1 Sep. 11, 2008

(30) Foreign Application Priority Data

Mar. 5, 2007 (JP) ..... 2007-053744

(51) Int. Cl.
*D05B 57/30* (2006.01)
*D05B 3/00* (2006.01)

(52) U.S. Cl. ..... 112/184; 112/220

(58) Field of Classification Search ..... 112/201, 112/202, 193, 191, 189, 228, 220
See application file for complete search history.

(56) References Cited

U.S. PATENT DOCUMENTS

| | | | | |
|---|---|---|---|---|
| 1,095,199 | A * | 5/1914 | Fink | 112/98 |
| 2,095,450 | A * | 10/1937 | Myers | 112/184 |
| 2,148,385 | A * | 2/1939 | Waterman | 112/184 |
| 2,609,770 | A * | 9/1952 | Christensen | 112/202 |
| 2,866,425 | A * | 12/1958 | Palmbach | 112/182 |
| 3,910,161 | A * | 10/1975 | Beckwell | 91/375 R |
| 6,269,760 | B1 | 8/2001 | Moore | |

FOREIGN PATENT DOCUMENTS

| | | |
|---|---|---|
| JP | U-58-174072 | 11/1983 |
| JP | B2-61-030596 | 7/1986 |
| JP | A-03-261497 | 11/1991 |
| JP | A-03-289987 | 12/1991 |
| JP | A-04-166187 | 6/1992 |
| JP | A-04-208193 | 7/1992 |
| JP | B2-07-028976 | 4/1995 |
| JP | A-2000-084272 | 3/2000 |
| JP | A-2002-143589 | 5/2002 |
| JP | A-2006-61594 | 3/2006 |
| JP | A-2006-87812 | 4/2006 |

* cited by examiner

*Primary Examiner*—Ismael Izaguirre
(74) *Attorney, Agent, or Firm*—Oliff & Berridge, PLC

(57) ABSTRACT

A sewing machine includes a rotating hook, a lower shaft rotating the rotating hook in synchronization with vertical movement of the needlebar, a lower shaft gear including a helical gear and slidably mounted on the lower shaft, a hook gear including a helical gear capable of mesh engagement with the lower shaft gear and mounted on the rotating hook, a drive force transmission mechanism supporting the lower shaft gear so that the lower shaft gear is axially moveable and transmits rotation of the lower shaft to the lower shaft gear, a cam mechanism axially moving the lower shaft gear to adjust at least one of a left encounter timing for seizure of the needle thread loop by the hook beak when the needle occupies a left needle location and a right encounter timing for seizure of the needle thread loop by the hook beak when the needle occupies a right needle location.

8 Claims, 8 Drawing Sheets

RIGHT NEEDLE LOCATION (NR)

LEFT NEEDLE LOCATION (NL)

SEWING MACHINE

CROSS-REFERENCE TO RELATED APPLICATIONS

This application is based on and claims the benefit of priority from the prior Japanese Patent Application No. 2007-53744, filed on Mar. 5, 2007, the entire contents of which are incorporated herein by reference.

BACKGROUND

1. Field

The present invention relates to a sewing machine having a needle swinging mechanism that swings a needle bar to a left needle location and a right needle location.

2. Related Art

Conventional lock stitch sewing machines capable of zigzag stitch comprise a needlebar, a needlebar vertical movement mechanism and a rotating hook. The needlebar has a lower end to which a sewing needle is attached. A needle has a needle eye through which a needle thread is insertable. The needlebar vertical movement mechanism moves the needlebar upward and downward. The rotating hook seizes a needle thread loop formed near to the needle eye.

A type of sewing machine is provided with a needle swinging mechanism which is capable of swinging a needle right and left between left and right needle locations. In this type of sewing machine, a timing of seizure of a thread loop by a hook beak in the case where a needlebar occupies the left needle location differs from a timing for seizure of a thread loop by the hook beak in the case where the needlebar occupies the right needle location. More specifically, when a location where the hook beak seizes the needle thread loop correspond to an encounter timing, the height of the needle eye relative to the hook beak in synchronization with encounter of the hook beak with the needle thread loop in the case where the needlebar occupies the right needle location is located lower than the needle eye relative to the hook beak in synchronization with encounter of the hook beak with the needle thread loop in the case where the needlebar occupies the left needlebar location. As a result, the hook beak passes through an area where an upper part of the needle thread loop has a smaller width, whereupon there is a possibility that the hook beak cannot reliably hook the needle thread loop thereby to seize the same and accordingly a possibility of stitch skipping.

In view of the foregoing problem, for example, JP-H04-166187 discloses a rotating hook for a sewing machine, in which a non-circular gear provided on an upper shaft is engaged with another non-circular gear provided on an intermediate gear and intermediate and lower shafts are coupled together by a timing belt. As a result, rotational speeds of the upper and lower shafts are set at the same value. The rotational speed of the lower shaft is changed so that the rotational speed of the rotating hook is reduced before the needle thread is reliably seized by the hook beak of the rotating hook. Consequently, the needle thread can reliably be seized by the hook beak of the rotating hook and accordingly, stitches can reliably be formed.

Furthermore, JP-H03-261497 discloses a zigzag sewing machine provided with a needle driving motor, a needle swinging motor and a hook driving motor. The needle driving motor vertically drives a needlebar having a lower end to which a sewing needle is attached. The needle swinging motor swings the needlebar between right and left needle locations. The hook driving motor drives an outer hook serving as a thread loop taker. In this case, the needle driving motor and the hook driving motor are controlled individually. As a result, even in the case where a needle falls onto either right or left needle location, an optimum thread loop which can reliably be seized by a hook beak can be formed.

The non-circular gears of the upper and intermediate shafts are engaged with each other in the sewing machine described in JP-H04-166187. Accordingly, rotating torque becomes non-uniform when rotation of the upper shaft is transferred to the intermediate shaft. As a result, noise due to backlash of the non-circular gears or rattling noise is produced particularly when a sewing speed is increased. Such a noise results in not only worsening of working conditions but also reduction in the durability of the sewing machine.

The needle swinging motor and the hook driving motor need to be controlled individually on the basis of sewing data in the sewing machine described in JP-H03-261497. Accordingly, motor control is complicated. Furthermore, since a plurality of electric motors including the needle swinging motor and the hook driving motor, the weight and size of the sewing machine are increased and the costs of the sewing machine are accordingly increased.

SUMMARY

Therefore, an object of the present disclosure is to provide a sewing machine which can reliably prevent stitch skipping when a sewing operation is carried out while the sewing needle is swung between the right and left needle locations.

The present disclosure provides a sewing machine comprising a needlebar to which a sewing needle having an eye is attached, a needlebar vertical movement mechanism which drives the needlebar vertically, a needle swinging mechanism which drives the needlebar so that the needlebar is swingable right and left, a rotating hook having a hook beak which is capable of seizing a loop of a needle thread extending through the needle eye, a lower shaft which rotates the rotating hook in synchronization with vertical movement of the needlebar, a lower shaft gear which is comprised of a helical gear and slidably mounted on the lower shaft, a hook gear comprised of a helical gear capable of mesh engagement with the lower shaft gear and mounted on the rotating hook, a drive force transmission mechanism which supports the lower shaft gear so that the lower shaft gear is axially moveable and transmits rotation of the lower shaft to the lower shaft gear, a cam mechanism which axially moves the lower shaft gear thereby to adjust at least one of a left encounter timing for seizure of the needle thread loop by the hook beak when the needle occupies a left needle location and a right encounter timing for seizure of the needle thread loop by the hook beak when the needle occupies a right needle location, and a machine frame on which are mounted the needlebar, the needlebar vertical movement mechanism, the needle swinging mechanism, the rotating hook, the lower shaft, the lower shaft gear, the hook gear, the drive force transmission mechanism and the cam mechanism.

The rotating hook is rotated unidirectionally when sewing is carried out while the sewing needle is swung between the right and left needle locations by the needle swinging mechanism. Accordingly, the right and left encounter timings differ from each other. The cam mechanism then axially moves the lower shaft gear through the drive force transmission mechanism. The lower shaft gear and the hook gear each comprise respective helical gears and are in mesh engagement with each other. Accordingly, the rotational speed of the hook gear is changed when the lower shaft gear is axially moved. Consequently, at least one of the right and left encounter timings is adjusted.

More specifically, the height of the sewing needle in the case of the right encounter timing differs from the height of the sewing needle in the case of the left encounter timing. The difference between the aforesaid heights becomes smaller. Accordingly, a timing for seizure of the needle thread loop by the hook beak is rendered more accurate in synchronization with encounter of the hook beak with the needle thread loop in the case where the sewing needle occupies the right or left needle location, whereupon an optimum needle thread loop which can reliably be seized by the hook beak can be formed. Consequently, since the hook beak seizes the needle thread loop reliably, occurrence of stitch skipping can be prevented.

The cam mechanism may have a cam body formed integrally with the lower shaft gear, a first cam groove formed in the cam body and a first pin member fixed to the machine frame and engageable with the first cam groove. Consequently, the construction of the cam mechanism is simplified and at least one of the right and left encounter timings can reliably be adjusted.

Furthermore, the cam groove may be formed so as to adjust the right encounter timing to a lag side without adjustment of the left encounter timing. Consequently, the right encounter timing is adjusted on the basis of the left encounter timing. More specifically, the left encounter timing is set as the timing for formation of a needle thread loop which can reliably be seized by the hook beak. On the basis of the left encounter timing, the right encounter timing is adjusted to the lag side so as to lead the left encounter timing and so that formation of the needle thread loop is insufficient. Consequently, the right encounter timing can also realize forming of a needle thread loop which can reliably be seized by the hook beak.

Furthermore, in a preferred embodiment, the lower shaft gear has both radial ends formed axially and the transmission pin has both ends. The drive force transmission mechanism has a transmission pin perpendicular to a shaft center of the lower shaft and extending through the lower shaft and a pair of engagement grooves which are formed in both radial ends of the lower shaft gear so as to be directed axially, respectively and with which the ends of the transmission pin are engaged.

The drive force transmission mechanism comprises the transmission pin and the paired engagement grooves and thus has a simple construction. Furthermore, rotation of the lower shaft can reliably be transmitted to the lower shaft gear.

In another preferred embodiment, the cam body has an outer peripheral wall and two axial ends. The first cam groove is formed in the outer peripheral wall of the cam body into a curved shape so that distances between the axial ends of the cam body and the first cam groove are changed in a rotational direction of the lower shaft. The first pin engages the curved first cam groove so that the lower shaft gear is axially moved, whereupon a rotational speed of the rotating hook is reduced until the right encounter timing and thereafter increased from the right encounter timing to the left encounter timing.

The sewing machine may further comprise a holding mechanism which holds the lower shaft gear thereby to limit an axial movement of the lower shaft gear, and a switching unit which is selectively switchable between a first state where the cam mechanism is operative and the holding mechanism is non-operative and a second state where the cam mechanism is non-operative and the holding mechanism is operative. Consequently, the cam mechanism can switch the sewing machine between the first state where the encounter timing is adjusted and the second state where the encounter timing is not adjusted.

Furthermore, the cam mechanism has a cam body formed integrally with the lower shaft gear and having an outer peripheral wall, a first cam groove formed in the cam body and a first pin member fixed to the machine frame and engageable with the first cam groove. The holding mechanism has an annular second cam groove forming on the outer peripheral wall of the cam body a plane perpendicular to a shaft center of the lower shaft, and a second pin member fixed to the machine frame and engaged with the second cam groove so that adjustment of the left or right encounter timing is not carried out. The switching unit includes a cam operating unit which is selectively switchable between the first state where the first pin member is engaged with the first cam groove and the second pin member is disengaged from the second cam groove and the second state where the first pin member is disengaged from the first cam groove and the second pin member is engaged with the second cam groove.

In the above-described construction, when the needlebar is to be swung, the first and second pin members are switched to the first state so that the right encounter timing is adjusted. On the other hand, when the needlebar is not to be swung, the first and second pin members are switched to the second state so that the lower shaft gear is not reciprocated right and left, whereby the encounter timing is not adjusted. Moreover, in the second state, the rotational speed of the hook gear brought into mesh engagement with the lower shaft gear is controlled to be constant. Consequently, noise due to backlash of the lower shaft gear and the hook gear can be reduced in the case of straight stitches which do not necessitate swinging of the needlebar.

Additionally, in another preferred embodiment, the cam body has an outer peripheral wall and two axial ends. The first cam groove is formed in the outer peripheral wall of the cam body into a curved shape so that distances between the axial ends of the cam body and the first cam groove are changed in a rotational direction of the lower shaft. The curved first cam groove is engaged with the first pin member so that the lower shaft gear is axially moved, whereupon a rotational speed of the rotating hook is reduced around the right encounter timing and thereafter increased from the right encounter timing to the left encounter timing.

BRIEF DESCRIPTION OF THE DRAWINGS

Other objects, features and advantages of the present disclosure will become clear upon reviewing the following description of embodiments with reference to the accompanying drawings, in which.

DETAILED DESCRIPTION OF THE INVENTION

A lower shaft and a horizontal rotating hook with a hook beak are provided with respective helical gears in a sewing machine of the embodiment. An encounter timing of the hook beak to encounter a needle thread loop formed near a needle eye is adjusted so as to lag behind a right encounter timing in the case where the needle occupies a right needle location. Consequently, the hook beak of the horizontal rotating hook can reliably seize the needle thread loop in synchronization with occupation of each of the right and left needle locations by the needle, whereupon the stitch skipping can be prevented. Similar or identical parts are labeled by the same reference symbols in plural embodiments and duplicative description of these similar or identical parts will be eliminated.

FIRST EMBODIMENT

Figure 1:
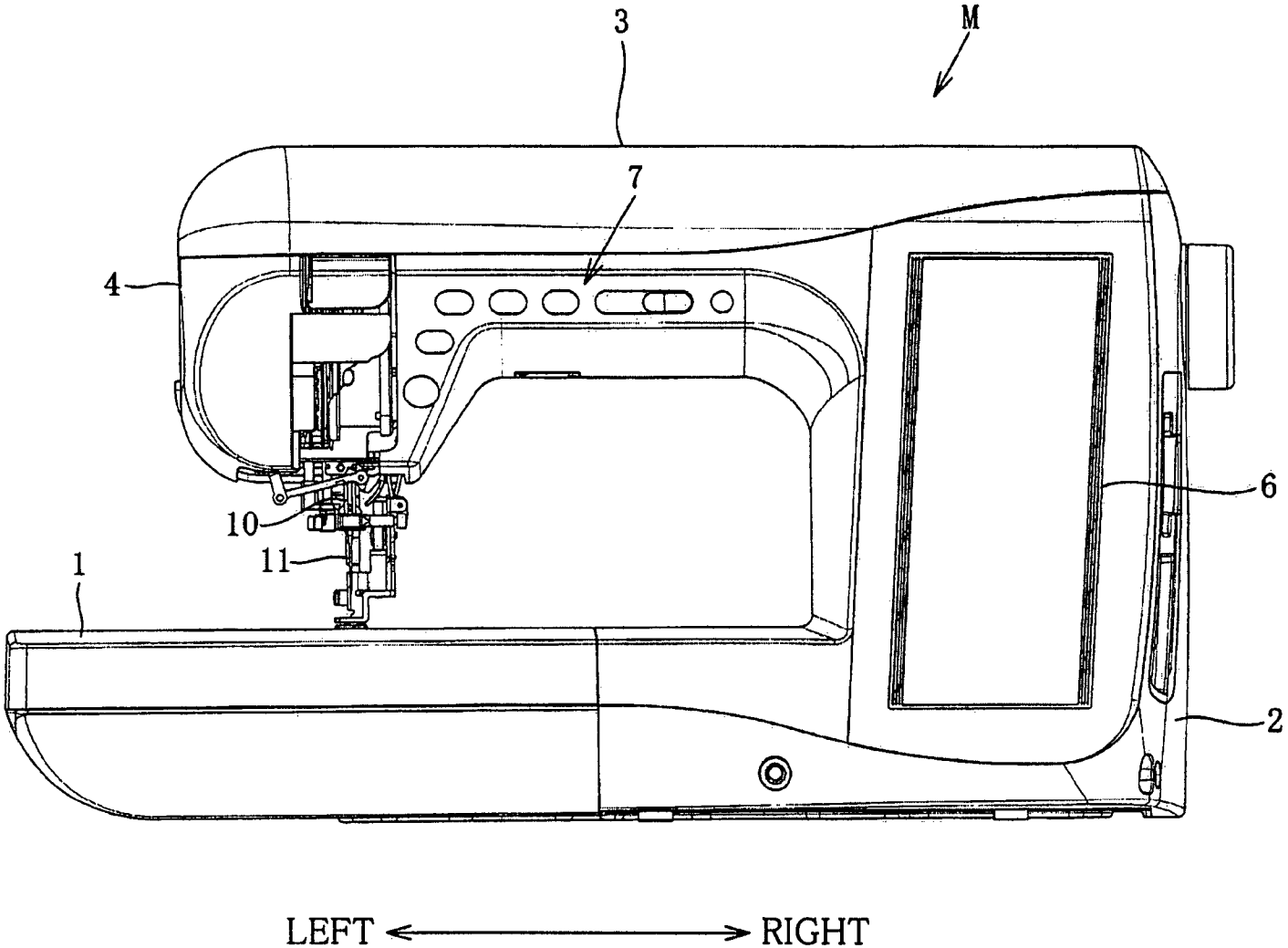
FIG. 1 is a front view of the sewing machine of one embodiment in accordance with the present invention.
Figure 2:
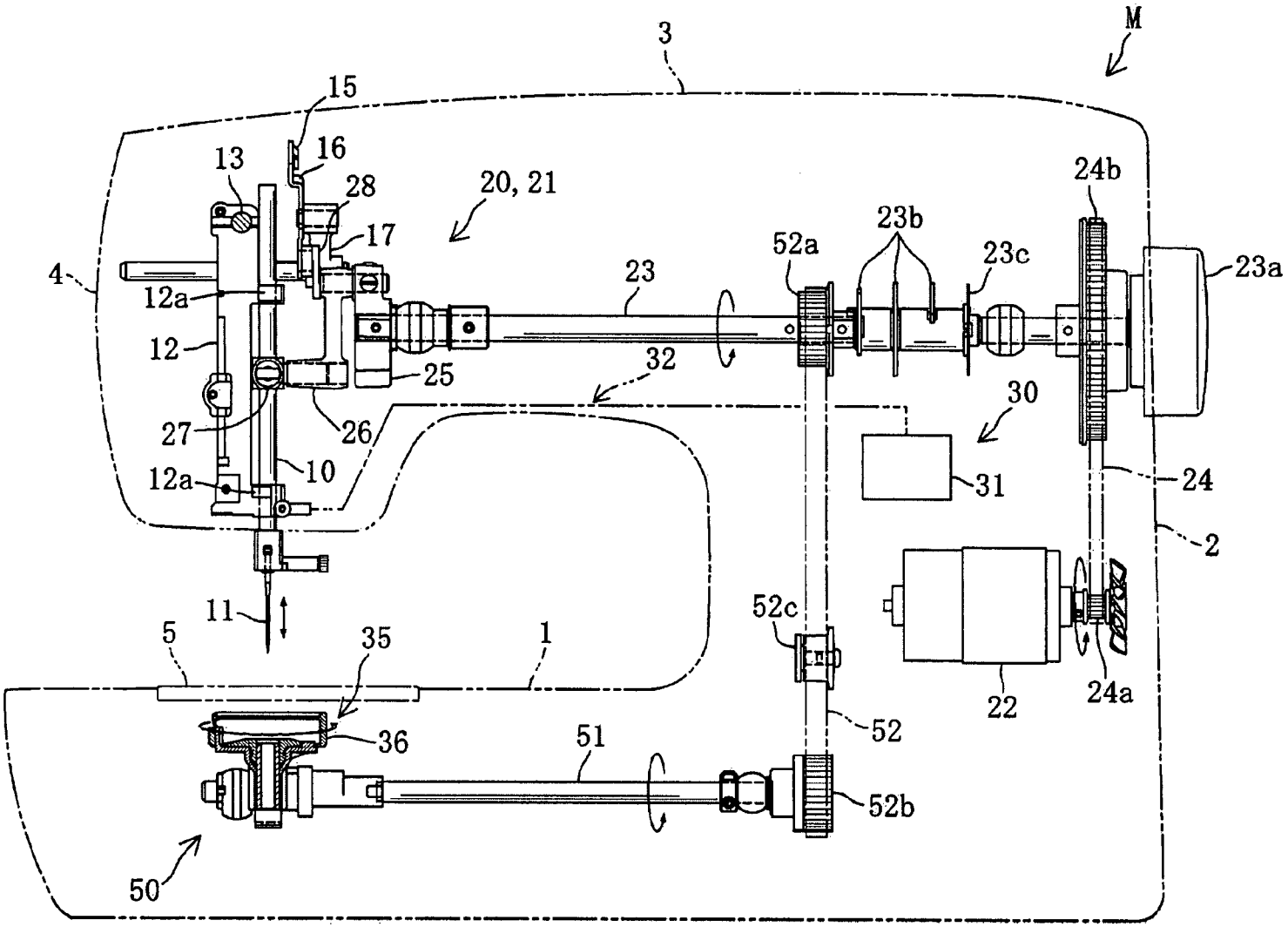
FIG. 2 is a schematic front view of the sewing machine, showing an inner structure thereof.

Referring now to FIGS. 1 and 2, a sewing machine M of the embodiment comprises a sewing bed 1, a pillar 2 and an arm 3. The pillar 2 is mounted on a right end of the bed 1. The arm 3 extends leftward from an upper portion of the pillar 2. A sewing head 4 is mounted on a left end of the arm 3. A needle plate 5 is mounted on an upper surface of the bed 1 opposed to the head 4. A liquid-crystal display 6 is mounted on a front of the pillar 2. Various operation switches 7 are provided on the fronts of the arm 3 and head 4. The sewing machine M further includes a needlebar 10, a sewing needle 11, a needle thread take-up 15, a needlebar vertical movement mechanism 20, a needle thread take-up swinging mechanism 21, a needle swinging mechanism 30, a horizontal rotating hook 35 and a hook driving mechanism 50.

The needlebar 10 is mounted on the head 4 so as to be reciprocable vertically and moveable horizontally as shown in FIG. 2. The needlebar 10 has a lower end protruding downward from the head 4. The sewing needle 11 is attached to the lower end of the needlebar 10 and has an eye 11*b*. A needle thread 8 is caused to pass through the eye 11*b*. A needlebar frame 12 is provided on the head 4 and has an upper end which is pivotally mounted on a support shaft 13 extending in a front-back direction. As a result, the needlebar 10 is supported on a pair of upper and lower guides 12*a* of the needlebar frame 12 so as to be moveable vertically. The needlebar 10 includes a part which is located between the paired guides 12*a* and supported by the needlebar vertical movement mechanism 20. The needlebar 10 is vertically driven by the needlebar vertical movement mechanism 20. The needle thread take-up 15 is mounted on the head 15 so as to be swingable vertically and is driven by the needlebar vertical movement mechanism 20.

Figure 6:
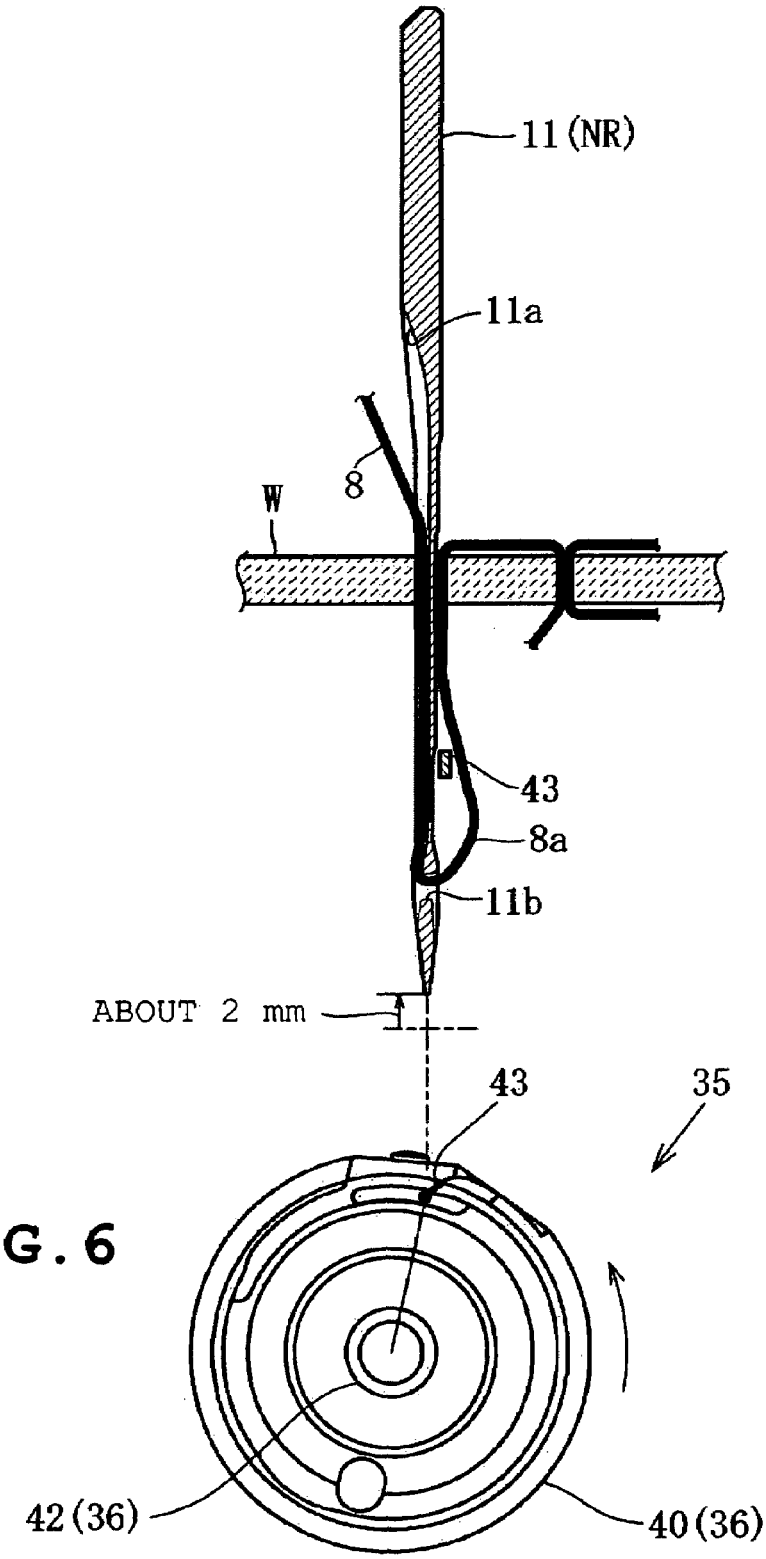
FIG. 6 is a view explaining a right encounter timing of the sewing needle assuming a right-side needle location.

A thread spool (not shown) serving as a needle thread supply is attached to a predetermined portion of the arm 3. The needle thread 8 extending from the thread spool is supplied via a thread tension regulator (not shown) and the needle thread take-up 15 to the sewing needle 11. The needle 11 has a vertically elongate groove 11*a* formed in a left lower part thereof as shown in FIG. 6. The groove 11*a* has a lower end in which the eye 11*b* is formed. The needle thread 8 extending from the needle thread take-up 15 is passed through the eye 11*b* from the left side. In particular, when inserted through workpiece cloth W, the needle thread 8 continues to the workpiece cloth before one stitch. FIG. 6 shows the sewing needle 11 as viewed from the right side relative to the front of the sewing machine M. Accordingly, the groove 11*a* is formed in the front. On the other hand, the eye 11*b* penetrates rearward from the front.

Most components of the needlebar vertical movement mechanism 20 are common to the needle thread take-up swinging mechanism 21 as shown in FIG. 2. A sewing machine motor 22, an upper shaft 23, a timing belt 24 and a crank member 25 are common to both mechanisms 20 and 21. The needlebar vertical movement mechanism 20 further has a needlebar crank rod 26 and a needlebar connecting stud 27. On the other hand, the needle thread take-up swinging mechanism 21 further has a needle thread take-up arm 28.

The sewing machine motor 22 is provided in the pillar 2. The upper shaft 23 extends horizontally and is rotatably mounted on the arm 3. Two pulleys 24*a* and 24*b* are fixed to an output shaft of the machine motor 22 and a right end of the upper shaft 23 respectively. A timing belt 24 extends between the pulleys 24*a* and 24*b*. The upper shaft 23 has a right end to which an operation pulley 23*a* is fixed. The pulley 23*a* protrudes rightward from the pillar 2 in order that the upper shaft 23 is operated. A rotary shutter 23*b* and an encoder disc 23*c* are fixed to the upper shaft 23. The rotary shutter 23*b* comprises a sectorial shield plate. The encoder disc 23*c* is formed with a plurality of small slits. The rotary shutter 23*b* and the encoder disc 23*c* overlap each other so that a phase angle of the upper shaft 23 is detected. Rotation of the rotary shutter 23*b* and the encoder disc 23*c* is optically detected by an upper shaft angle sensor (not shown). The upper shaft angle sensor is mounted on a sewing machine frame of the sewing machine M.

A crank member 25 is fixed to a left end of the upper shaft 23. The crank member 25 includes a part eccentric relative to the upper shaft 23. The crank rod 26 has one of two ends which is connected to the eccentric part of the crank member 25 so as to pivot about a horizontal axis. The needlebar connecting stud 27 is fixed to a portion of the needlebar 10 which is located between the paired guides 12*a*. The crank rod 26 has the other end which is connected to the needlebar connecting stud 27 so as to be pivotable about the horizontal axis and so that the needlebar 10 is swingable right and left. The needle thread take-up arm 28 has one of two ends which is fixed via the one end of the crank rod 26 to the eccentric part of the crank member 25.

Figure 7:
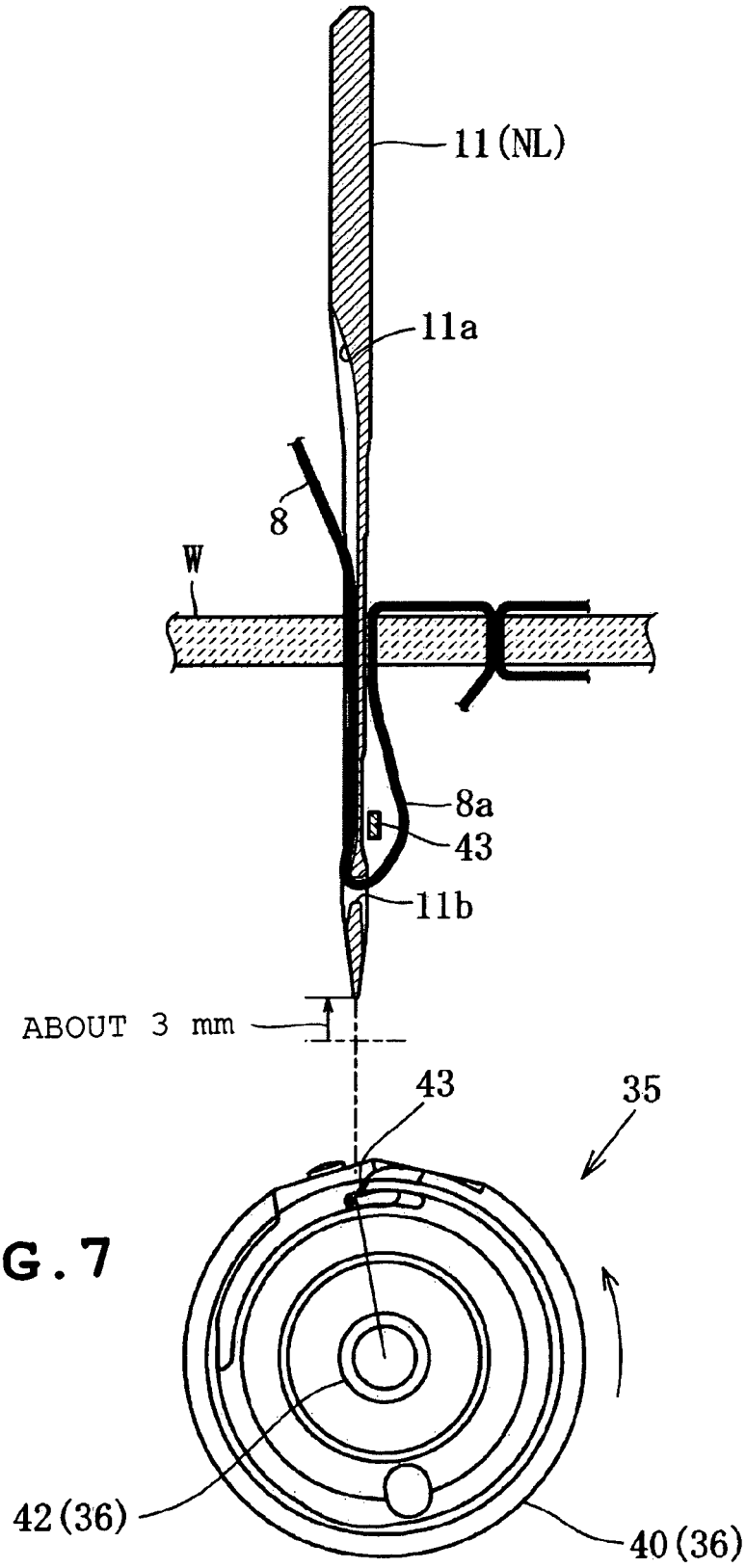
FIG. 7 is a view explaining a left encounter timing of the sewing needle assuming a left-side needle location.

The needle swinging mechanism 30 has a needle swinging motor 31 and a drive transmission system 32 as shown in FIG. 2. The needle swinging motor 31 comprises a stepping motor provided in the pillar 2. The needle swinging mechanism 30 transmits the driving force of the needle swinging motor 31 to the lower end of the needlebar frame 12. The needle swinging mechanism 30 swings the sewing needle 11 of the needlebar 10 between a right needle location NR as shown in FIG. 6 and a left needle location NL as shown in FIG. 7. The maximum zigzag width between the right and left needle locations NR and NL are set at about 7 mm. The left needle location NL is set as a normal needle location. During the swinging of the needle 11 by the needle swinging mechanism 30, the needle 11 is swung between the left needle location NL as the normal needle location and the right needle location NR.

A horizontal rotating hook 35 is provided in the sewing bed 1 so as to be located below the needle plate 5 as shown in FIGS. 2, 6 and 7. The rotating hook 35 has an outer hook 36 and an inner hook (not shown). The outer hook 36 has an outer hook body 40, a hook shaft section 42 and a hook shaft (not shown). The hook shaft section 42 extends vertically and is fixed to the outer hook body 40. The hook shaft is inserted into the hook shaft section 42 so as to support the hook support section 42 so that the hook support section 42 is rotatable. The outer hook body 40 has a hook beak 43 which seizes a loop 8*a* of the needle thread 8 formed near the eye 11*b* of the needle

11, in synchronization with encounter of the hook beak 43 with the needle thread 8 extending through the eye 11*b*.

The outer hook body 40 is connected via the hook shaft section 42 to a hook driving mechanism 50, so that the outer hook 36 is rotated counterclockwise by the hook driving mechanism 50 in synchronization with the vertical movement of the needlebar 10. The hook beak 43 is mounted on the outer hook body 40. The outer hook 36 is rotated counterclockwise during sewing so that the hook beak 43 seizes the loop 8*a* of the needle thread 8 formed near the eye 11*b* of the needle 11. More specifically, when the needle 11 drops to the left needle location NL as shown in FIG. 7, the hook beak 43 seizes the loop 8*a* of the needle thread 8 in synchronization with encounter with the needle thread 8 on the left (a left encounter timing). The left encounter timing is represented by an upper shaft rotation angle θ of about 210°. Furthermore, when the needle 11 drops to a right needle location NR as shown in FIG. 6, the hook beak 43 seizes the loop 8*a* of the needle thread 8 in synchronization with encounter with the needle thread 8 on the right (a right encounter timing). The right encounter timing is represented by the upper shaft rotation angle θ of about 200°.

The hook driving mechanism 50 has a sewing machine motor 22, a pulley 52*a* of the upper shaft, a lower shaft 51, a pulley 52*b* of the lower shaft 51, a timing belt 52, a lower shaft gear 53, a hook gear 54 and the like. The sewing machine motor 22 is common to the needlebar vertical movement mechanism 20 and the needle thread take-up swinging mechanism 21. The lower shaft gear 53 is mounted on a left end of the lower shaft 51. The hook gear 54 is mounted on the hook shaft section 42 of the rotating hook 35. The lower shaft 51 extends horizontally and is rotatably supported on the sewing bed 1. The timing belt 52 extends between the pulley 52*a* fixed to the upper shaft 23 and the pulley 52*b* fixed to a right end of the lower shaft 51. A tensioner pulley 52*c* is mounted on the middle of the timing belt 52 so that a sufficient tension is applied to the timing belt 52.

The lower shaft gear 53 comprises a helical gear which is twisted rightward. The hook gear 54 is fixed to the hook shaft section 42. The horizontally directed lower shaft gear 53 and the vertically directed hook gear 54 are in mesh engagement with each other. The lower shaft gear 51 and the hook gear 54 have predetermined pitch diameters respectively. A ratio of the pitch diameters is 2:1. Accordingly, when the lower shaft 51 is rotated one turn, the outer hook 36 is rotated two turns.

A drive force transmitting mechanism 57 will now be described. The drive force transmitting mechanism 57 has a transfer pin 58 and engagement grooves 53*a*. The transfer pin 58 is mounted on the lower shaft 51. A pair of the engagement grooves 53*a* are radially formed on the upper and lower ends of the lower shaft 53 respectively. The transfer pin 58 is located at a right end of the lower shaft gear 53 and extends through the lower shaft 51 perpendicularly to the shaft center of the lower shaft. In this case, both ends of the transfer pin 58 protrude from the lower shaft.

Figure 5:
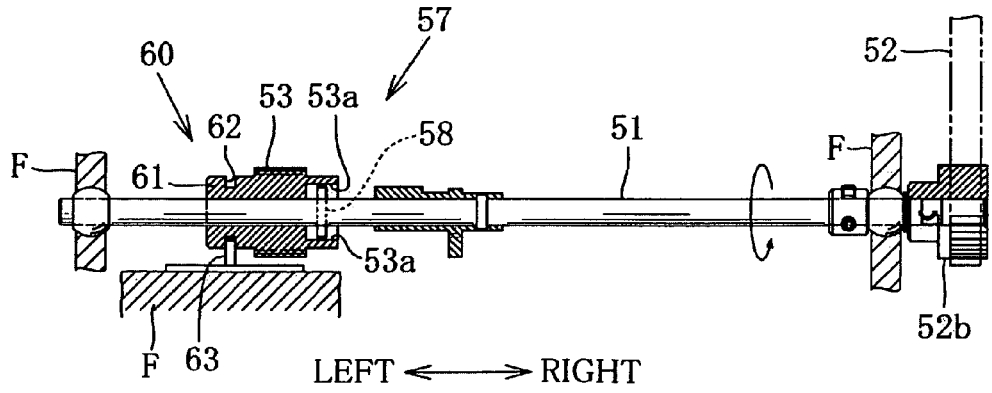
FIG. 5 is a longitudinal sectional front view of the lower shaft.

A pair of engagement grooves 53*a* are formed in a right end of the lower shaft 53 as shown in FIG. 5. Both ends of the transfer pin 58 protruding from the lower shaft 51 engage the engagement grooves 53*a* respectively. Each engagement groove 53*a* extends a predetermined length axially with respect to the lower shaft 51. When the lower shaft 51 is driven via the timing belts 24 and 52 by the machine motor 22, the lower shaft gear 53 is rotated by the transfer pins 58 in engagement with the paired engagement grooves 53*a* respectively. The horizontal rotating hook 35 is rotated upon rotation of the hook gear 54 in mesh engagement with the lower shaft gear 53. In this case, the lower shaft gear 53 is moveable axially with respect to the lower shaft 51 while rotated by the drive force of the hook gear 54.

Figure 3:
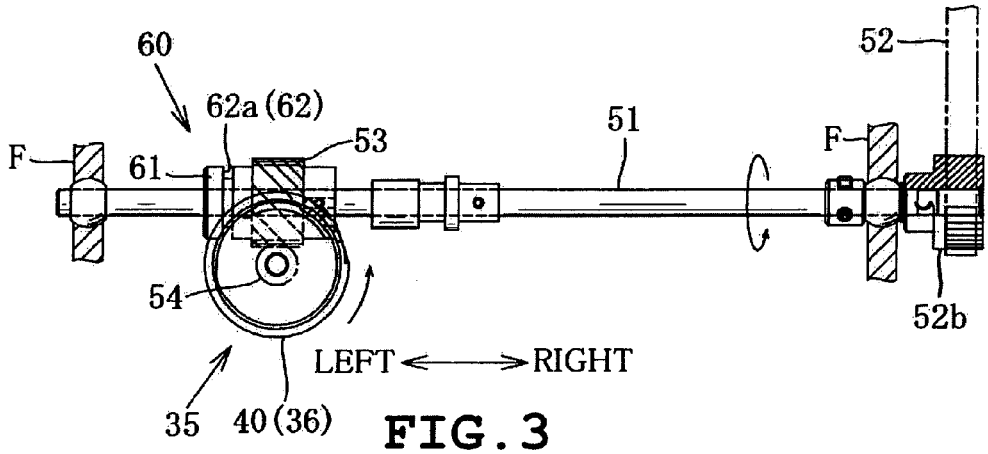
FIG. 3 is a plan view of a lower shaft and a horizontal rotating hook.
Figure 4:
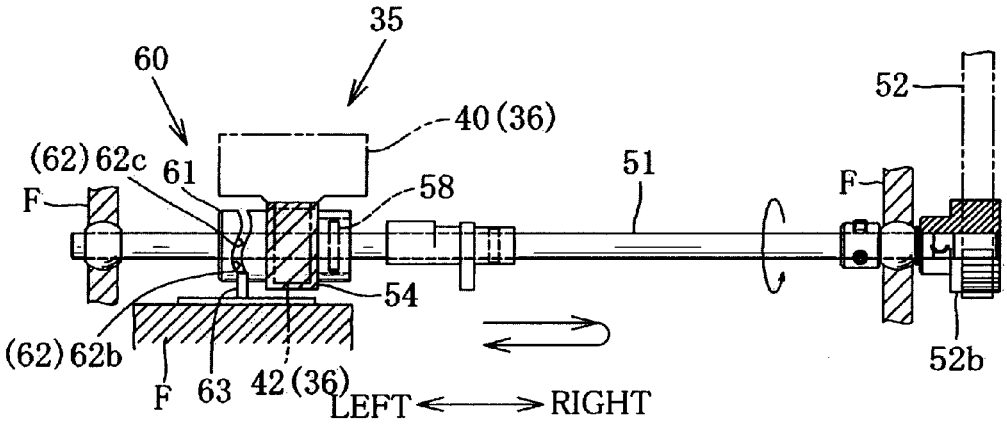
FIG. 4 is a front view of the lower shaft and the horizontal rotating hook.

A cam mechanism 60 will now be described. The cam mechanism 60 adjusts the left encounter timing for seizure of the loop 8*a* of the needle thread 8 by the hook beak 43. The cam mechanism 60 has a cam groove 62 and an engagement pin 63 serving as a pin member as shown in FIGS. 4 and 5. The cam groove 62 is formed in an outer peripheral wall of a cam body 61 which is formed integrally with the lower shaft gear 53. The engagement pin 63 is fixed to the machine frame F of the sewing machine M and engages a cam groove 62. The ca body 61 comprises an annular cylindrical member formed integrally on the left end of the lower shaft gear 53 and has a predetermined width as shown in FIGS. 3 to 5. The cam body 61 is moveable axially with respect to the lower shaft 51 together with the lower shaft gear 53. The cam body 61 has an outer peripheral wall formed with a cam groove 62. An annular groove 62*a* formed along the outer periphery of the cam body 61 constitutes a most part of the cam groove 62. On the other hand, the cam groove 62 has a lagging control cam section 62*b* a part of which is continuous to the annular groove 62*c* and a leading control cam section 62*c*. Portions of the cam groove 62 corresponding to the lagging and leading control cam grooves 62*b* and 62*c* are each formed into a zigzag shape.

The engagement pin 63 has a proximal end fixed to the machine frame F near to the cam body 61. The engagement pin 63 has a distal end which is normally in engagement with the cam groove 62 so as to be perpendicular to the cam groove 62. In the embodiment, the cam mechanism 60 is adapted to adjust the right encounter timing to the lag side by way of the lagging control cam section 62*b* of the cam groove 62 without adjustment of the left encounter timing. The leading control cam section 62*c* returns the lagged encounter timing to the left encounter timing, namely, is provided for causing the encounter timing to lead.

Figure 8:
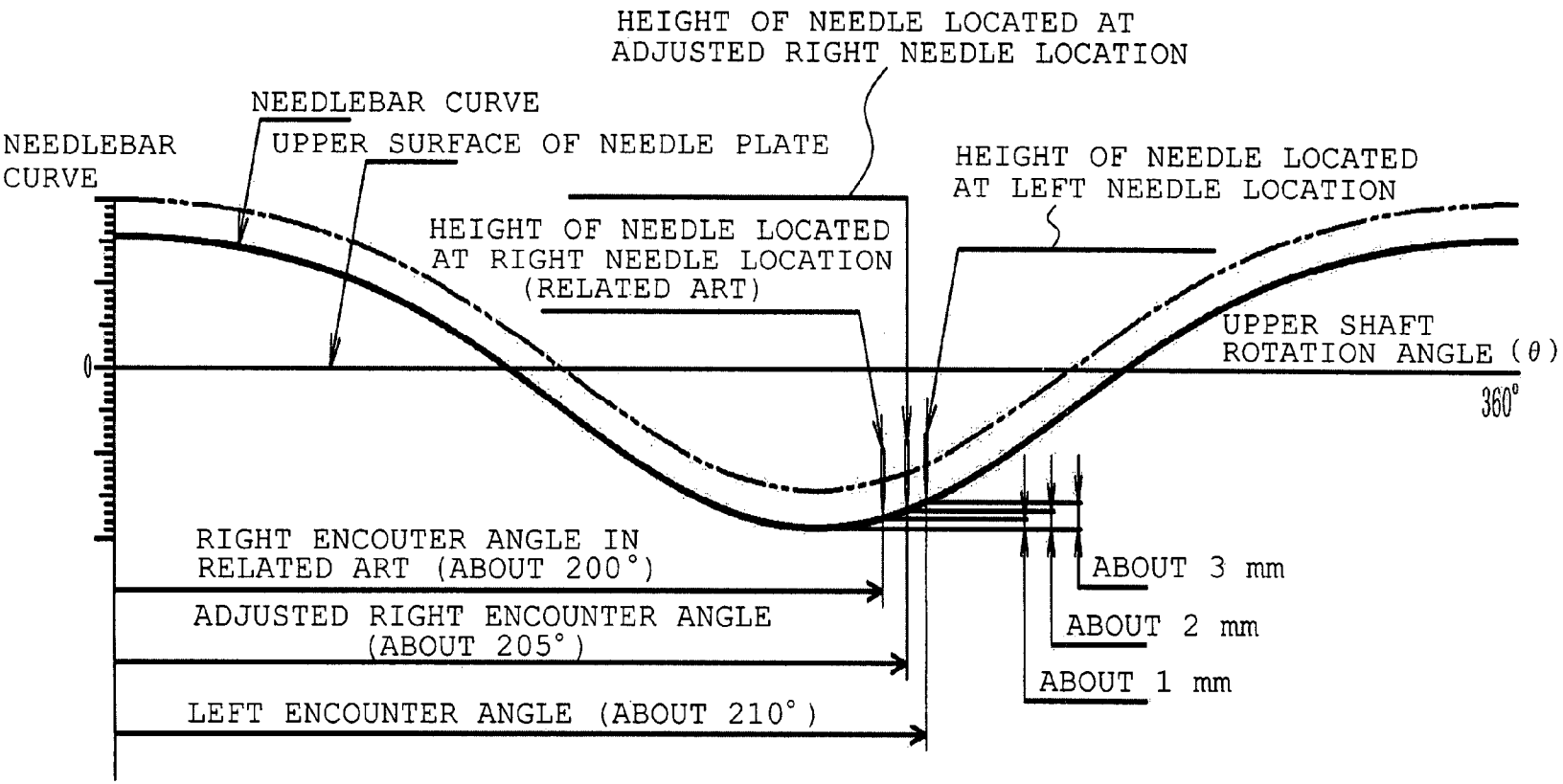
FIG. 8 is a graph showing a needlebar curve.

FIG. 8 is a graph showing a needlebar curve in the case where an axis of abscissas denotes a rotational angle θ of the upper shaft 23 when "0°" indicates the case where the sewing needle 11 or needlebar 10 is located at a highest position. An axis of ordinates indicates a location of the distal end or lowest end of the needle 11. In a conventional sewing machine in which an encounter timing is not adjusted, the right encounter timing is met when the needle 11 is located at the right needle location NR and the upper shaft rotation angle θ is about 200°. More specifically, when the rotation angle θ of the upper shaft is about 200°, the hook beak 43 of the rotating hook 35 seizes the loop 8*a* formed near the eye 11*b* of the needle 11. In this case, the needle 11 is located at a position which is about 1 mm higher than a lowest position.

In the conventional sewing machine, furthermore, the right encounter timing is met when the needlebar 10 occupies the left needle location and the rotation angle θ of the upper shaft 23 is about 210°. More specifically, when the rotation angle θ of the upper shaft 23 is about 210°, the hook beak 43 of the rotating hook 35 seizes the loop 8*a* formed near the eye 11*b* of the sewing needle 11. In this case, the needle 11 is located at a position which is about 3 mm higher than the lowest position.

In other words, in the conventional sewing machine, the hook beak 43 seizes the loop 8*a* when the needle 11 occupies the left needle location NL (the left encounter timing). When the needle 11 occupies the right needle location NR, the hook beak 43 seizes the loop 8*a* earlier than the left encounter timing. The height of the eye 11*b* of the needle 11 at the left encounter timing is about 2 mm higher than the height of the eye 11*b* of the sewing needle 11 at the right encounter timing.

Consequently, the difference between the heights of the eye lib at the left and right encounter timings respectively is about 2 mm.

Figure 9:
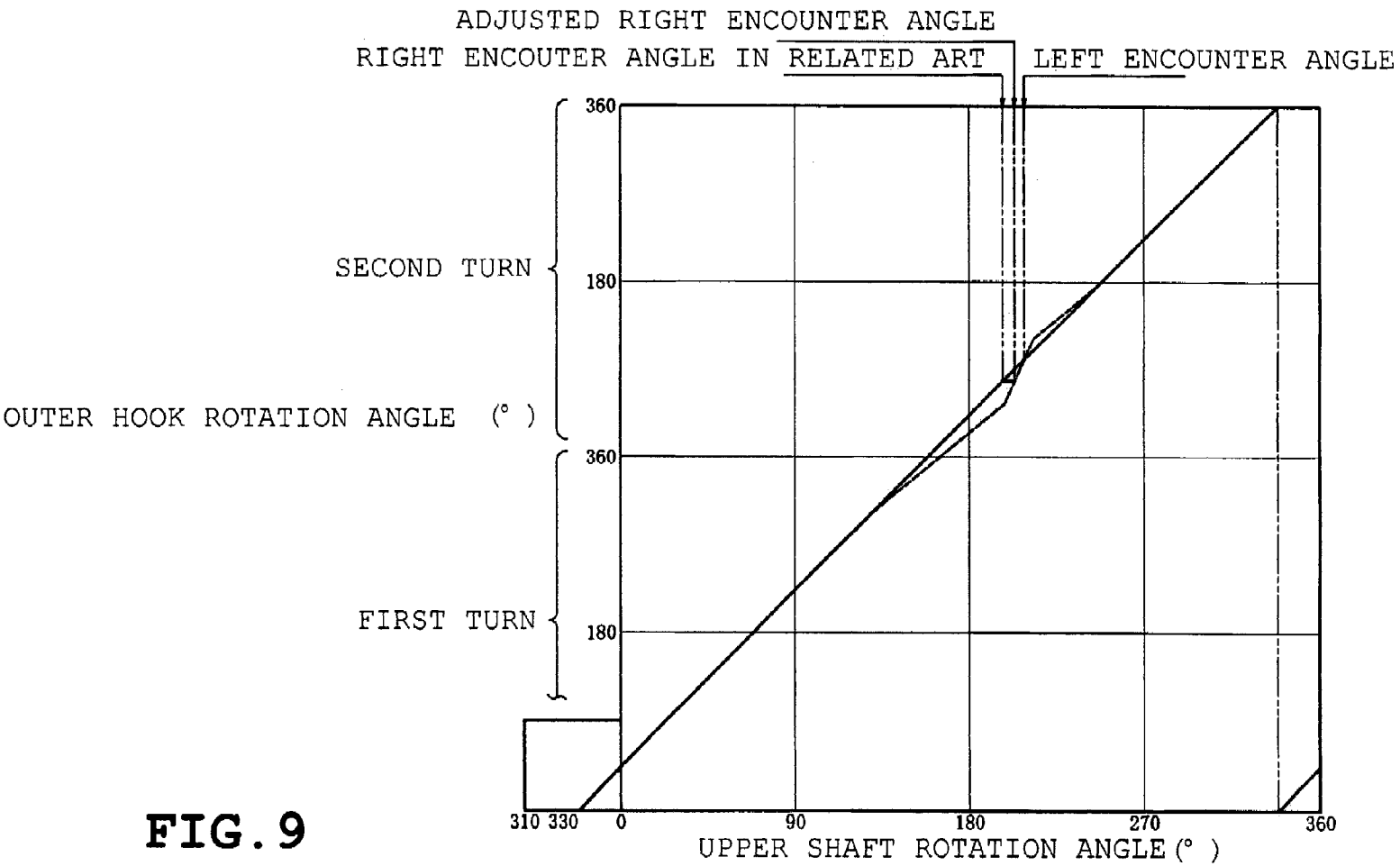
FIG. 9 is a graph showing a rotating angle of the outer hook relative to a rotating angle of an upper shaft.

The lower shaft gear 53 moves rightward when the engagement pin 63 reaches the lagging control cam section 62*b* at the right encounter timing as shown in FIGS. 4 and 9. The lower shaft gear 53 is a helical gear which is twisted rightward. Accordingly, the rotational speed of the hook gear 54 in mesh engagement with the lower shaft gear 53 or the rotational speed of the rotating hook 35 is reduced when the upper shaft rotation angle θ ranges from about 130° to about 200°, as shown by dotted line in FIG. 9. Consequently, when the needle 11 occupies the right needle location NR and the rotation angle θ of the upper shaft 23 is about 205°, the right encounter timing is adjusted to be met.

As the result of the aforesaid adjustment, in the first embodiment, the needle 11 encounters the hook beak 43 at a higher located than in the conventional sewing machine. In the sewing machine M of the first embodiment, the needle 11 occupies the location which is about 2 mm higher than the lowest position at the right encounter timing. As a result, the difference between the heights of the eye 11*b* at the left and right encounter timings respectively is reduced to about 1 mm.

The sewing machine M of the first embodiment comprises the needlebar 10 to which the needle 11 is attached, the needlebar vertical movement mechanism 20 for driving the needlebar 10 vertically, the needle swinging mechanism 30 which is capable of swinging the needlebar 10 right and left, the outer hook 36 having the hook beak 43 which is capable of seizing the needle thread 8 extending from the eye 11*b* of the needle 11, and the lower shaft 51 rotating the outer hook 43 in synchronization with the vertical movement of the needlebar 10. The sewing machine M further comprises the lower shaft gear 53, the hook gear 54, the driving force transmitting mechanism 57, and the cam mechanism 60. As a result, when sewing is carried out while the needle 11 is swung between the right and left needle locations NR and NL, the right encounter timing is adjusted so as to serve as the left encounter timing which corresponds to a sewing location during a normal sewing. Accordingly, the difference between the heights of the needle 11 at the right and left encounter timings is reduced, whereupon each of the locations of the needle 11 corresponding to the right and left encounter timings is a location where an optimum needle thread loop 8*a* which can reliably be seized by the hook beak 43. Consequently, the needle thread loop 8*a* can reliably be seized by the hook beak 43 and accordingly, stitch skipping can be prevented.

SECOND EMBODIMENT

A second embodiment of the invention will be described. The sewing machine of the second embodiment further comprises a holding mechanism 64 and a cam operating unit. The holding mechanism 64 engages the engagement pin 63 with the cam groove 62 when zigzag stitches are formed. On the other hand, when no zigzag stitches are formed, for example, when straight stitches are formed only in synchronization with encounter of the hook beak with the needle thread loop in the case where the needle occupies the left needle location NL, the holding mechanism 64 holds the lower shaft gear 53 so that the lower shaft gear 53 is immovable axially relative to the lower shaft 51. The cam operating unit switches the cam mechanism 60 between a first and a second states. The cam mechanism 60 is operative and the holding mechanism 64 is inoperative in the inoperative state. In the second state, the cam mechanism 60 is inoperative and the holding mechanism 64 is operative.

Figure 10:
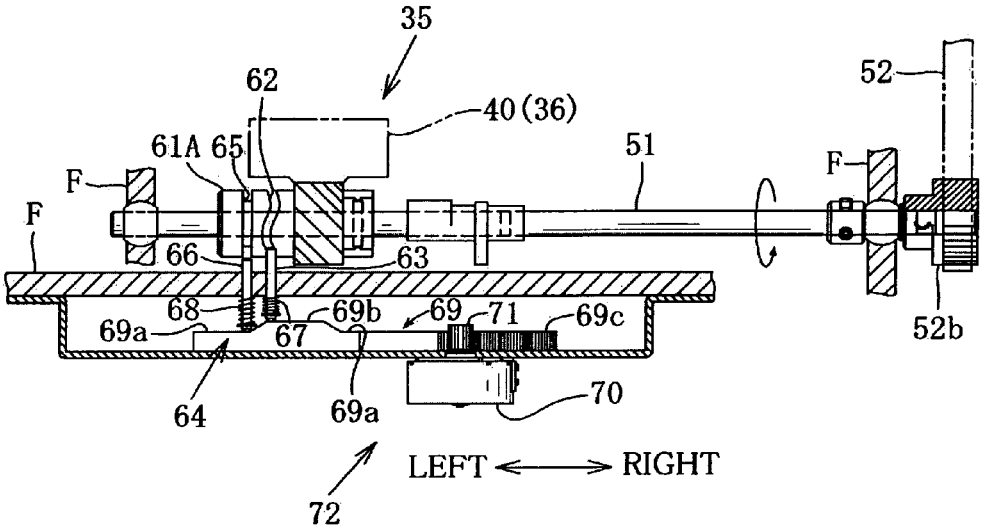
FIG. 10 is a view similar to FIG. 4, showing a first state in a modified form.
Figure 11:
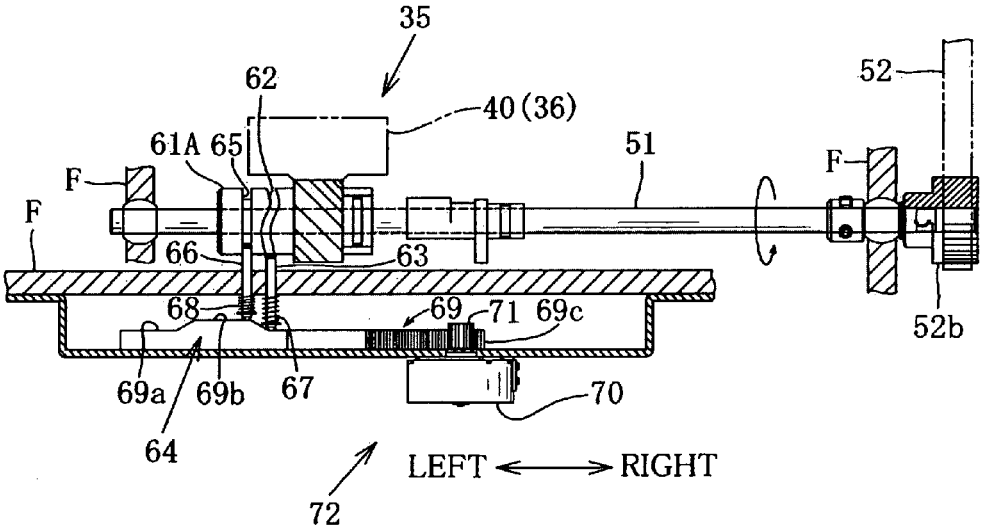
FIG. 11 is a view similar to FIG. 4, showing a second state in the modified form.

Describing the construction of the sewing machine of the second embodiment, an annular groove 65 serving as a second cam groove is formed in the outer peripheral wall of the cam body 61A as shown in FIGS. 10 and 11. The annular groove 65 is adjacent to the cam groove 62 and is located in a plane perpendicular to the shaft center of the lower shaft 51. The engagement pin 65 is mounted on the machine frame F so as to be engageable with and separable from the cam groove 62 and further biased by a compression coil spring 67 in such a direction that the engagement pin 65 departs from the cam groove 62. Furthermore, an auxiliary engagement pin 66 serving as a second pin member corresponding to the annular groove 65 is mounted on the machine frame F so as to be engageable with and separable from the annular groove 65. The auxiliary engagement pin 66 is further biased by a compression coil spring 68 in such a direction that the pin 66 is departed from the annular groove 65. Thus, the holding mechanism 64 comprises the annular groove 65 and the auxiliary engagement pin 66.

A cam operating plate 69 is mounted on the machine frame F so as to be slidable right and left. The cam operating plate 69 has a trapezoidal cam portion and a right end having a rack 69*c*. An electric motor 70 is mounted on the machine frame F. A pinion 71 which is brought into mesh engagement with the rack 69*c* is fixed to the motor 70. The cam operating plate 69 has two trapezoidal first cam surfaces 69*a* each of which has a smaller thickness and two larger-sized second cam surfaces 69*b* each of which has a larger thickness than the first cam surfaces 69*a*. The first or second cam surfaces 69*a* or 69*b* abut against a lower end of the auxiliary engagement pin 63 or 65.

A cam operating mechanism serving as the cam operating unit has the cam operating plate 69, the switching motor 70 and the like. When the switching motor 70 is rotated clockwise, the cam operating plate 69 is moved rightward as shown in FIG. 10. Accordingly, the auxiliary engagement pin 66 abuts against the first cam surface 69*a*, thereby disengaging from the annular groove 65. The engagement pin 63 runs onto the second cam surface 69*b* thereby to engage the cam groove 62, whereupon the cam mechanism 60 gets into the first state.

On the other hand, the cam operating plate 69 moves leftward when the switching motor 70 is rotated counterclockwise. Accordingly, the auxiliary engagement pin 66 runs onto the first cam surface 69*b* thereby to engage the annular groove 65, whereupon the cam mechanism gets into the second state. In this case, the annular groove 65 is formed merely into a simple annular shape. Accordingly, the left encounter timing is not adjusted and moreover, the right encounter timing is not adjusted, either. Then, in the case where the right encounter timing is adjusted when a zigzag sewing mode is carried out so that zigzag stitches are formed, the cam operating plate 69 is switched into the first state as shown in FIG. 10. More specifically, the motor 70 is driven so that the cam operating plate 69 is moved rightward in a range of the rotation angle θ of the upper shaft 23 from about 0° to about 120°. As a result, the right encounter timing is adjusted to the lagging side as described above.

On the other hand, when the right encounter timing is not adjusted in the case where the zigzag stitches are not formed or straight stitches are formed, the operating plate 69 is switched to the second state as shown in FIG. 11. More specifically, the motor 70 is driven so that the cam operating plate 69 is moved leftward, when the rotation angle θ of the upper shaft 23 ranges from about 0° to about 120°. As a result, the right encounter timing is not adjusted as described above, whereupon the rotational speed of the hook gear 54 in engagement with the lower shaft gear 51 maintains a constant speed without variations. Consequently, since the rotation of the rotating hook 35 is stabilized, occurrence of noise due to backlash of the lower shaft 51 and the hook gear 54 can further be reduced.

OTHER EMBODIMENTS

The above-described embodiments may be modified as follows. The swinging dimension may be increased between the lagging control cam portion 62*b* and the leading control cam portion 62*c* both formed in the cam groove 62. In this case, the hook beak 43 can seize the needle thread loop 8*a* even when the zigzag width of the needle 11 is larger than the current value of 7 mm. Accordingly, the occurrence of stitch skipping can be prevented.

In each of the above-described embodiments, the left needle location is set as the normal needle location and the right encounter timing is adjusted. However, the right needle location may be set as the normal needle location and the left encounter timing may be adjusted, instead. Furthermore, when a needle position in the middle between the right and left needle locations or a central needle position may be set as the normal needle position, both right and left encounter timings may be adjusted.

Each of the cam groove 62 and the annular groove 65 may be a cam comprising a protruding rib, instead of the grove. In this case, each of the engagement pin 63 and the auxiliary engagement pin 66 may be a member having such a shape that a cam portion of the protruding rib is held between portions of the member in the horizontal direction, instead of the pin member.

Furthermore, the cam groove 62 may be a face cams formed in the right and left ends of the lower shaft gear 51, instead of the groove. In this case, the engagement pin 63 may be a member having such a shape that the face cam is held between portions of the member in the horizontal direction, instead of the pin member.

Other modifications may be made into the foregoing embodiments without departing from the gist of the present invention. Additionally, the present invention may be applied to various types of sewing machines provided with a needle swinging mechanism and a vertical rotating hook.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A sewing machine comprising:

a needlebar to which a sewing needle having an eye is attached;

a needlebar vertical movement mechanism which drives the needlebar vertically;

a needle swinging mechanism which drives the needlebar so that the needlebar is swingable right and left;

a rotating hook having a hook beak which is capable of seizing a loop of a needle thread extending through the needle eye;

a lower shaft which rotates the rotating hook in synchronization with vertical movement of the needlebar;

a lower shaft gear which is comprised of a helical gear and slidably mounted on the lower shaft;

a hook gear comprised of a helical gear capable of mesh engagement with the lower shaft gear and mounted on the rotating hook;

a drive force transmission mechanism which supports the lower shaft gear so that the lower shaft gear is axially moveable and transmits rotation of the lower shaft to the lower shaft gear;

a cam mechanism which axially moves the lower shaft gear thereby to adjust at least one of a left encounter timing for seizure of the needle thread loop by the hook beak when the needle occupies a left needle location and a right encounter timing for seizure of the needle thread loop by the hook beak when the needle occupies a right needle location; and a machine frame on which are mounted the needlebar, the needlebar vertical movement mechanism, the needle swinging mechanism, the rotating hook, the lower shaft, the lower shaft gear, the hook gear, the drive force transmission mechanism and the cam mechanism.

2. The sewing machine according to claim 1, wherein the cam mechanism has a cam body formed integrally with the lower shaft gear, a first cam groove formed in the cam body and a first pin member fixed to the machine frame and engageable with the first cam groove.

3. The sewing machine according to claim 2, wherein the cam groove is formed so as to adjust the right encounter timing to a lag side without adjustment of the left encounter timing.

4. The sewing machine according to claim 1, wherein the lower shaft gear has both radial ends formed axially, and the drive force transmission mechanism has a transmission pin perpendicular to a shaft center of the lower shaft and extending through the lower shaft and a pair of engagement grooves which are formed in both radial ends of the lower shaft gear so as to be directed axially, respectively and with which ends of the transmission pin are engaged.

5. The sewing machine according to claim 2, wherein:

the cam body has an outer peripheral wall and two axial ends;

the first cam groove is formed in the outer peripheral wall of the cam body into a curved shape so that distances between the axial ends of the cam body and the first cam groove are changed in a rotational direction of the lower shaft; and the first pin engages the curved first cam groove so that the lower shaft gear is axially moved, whereupon a rotational speed of the rotating hook is reduced until the right encounter timing and thereafter increased from the right encounter timing to the left encounter timing.

6. The sewing machine according to claim 1, further comprising:

a holding mechanism which holds the lower shaft gear thereby to limit an axial movement of the lower shaft gear; and a switching unit which is selectively switchable between a first state where the cam mechanism is operative and the holding mechanism is non-operative and a second state where the cam mechanism is non-operative and the holding mechanism is operative.

7. The sewing machine according to claim 6, wherein:

the cam mechanism has a cam body formed integrally with the lower shaft gear and having an outer peripheral wall, a first cam groove formed in the cam body and a first pin member fixed to the machine frame and engageable with the first cam groove;

the holding mechanism has an annular second cam groove forming on the outer peripheral wall of the cam body a plane perpendicular to a shaft center of the lower shaft, and a second pin member fixed to the machine frame and engaged with the second cam groove so that adjustment of the left or right encounter timing is not carried out; and the switching unit includes a cam operating unit which is selectively switchable between the first state where the first pin member is engaged with the first cam groove and the second pin member is disengaged from the second cam groove and the second state where the first pin member is disengaged from the first cam groove and the second pin member is engaged with the second cam groove.

8. The sewing machine according to claim 7, wherein:

the cam body has an outer peripheral wall and two axial ends;

the first cam groove is formed in the outer peripheral wall of the cam body into a curved shape so that distances between the axial ends of the cam body and the first cam groove are changed in a rotational direction of the lower shaft; and the curved first cam groove is engaged with the first pin member so that the lower shaft gear is axially moved, whereupon a rotational speed of the rotating hook is reduced around the right encounter timing and thereafter increased from the right encounter timing to the left encounter timing.

* * * * *